US006223639B1

(12) United States Patent
Chen

(10) Patent No.: US 6,223,639 B1
(45) Date of Patent: May 1, 2001

(54) ALUMINUM FOIL SAFETY FIXTURE

(76) Inventor: Su-Hui Chen, No., 58, Wen Tung 5 St., Kweishan., Taoyuan Hsien (TW)

( * ) Notice: Subject to any disclaimer, the term of this patent is extended or adjusted under 35 U.S.C. 154(b) by 0 days.

(21) Appl. No.: 09/373,633

(22) Filed: Aug. 13, 1999

(51) Int. Cl.[7] ..... B26D 5/08

(52) U.S. Cl. ..... 83/614; 83/56; 83/649; 225/93

(58) Field of Search ..... 83/56, 445, 614, 83/649; 225/93, 106

(56) References Cited

U.S. PATENT DOCUMENTS 4,417,495 * 11/1983 Gordon et al. ..... 225/93
4,960,022 * 10/1990 Churng ..... 83/614
5,036,740 * 8/1991 Tsai ..... 83/614
5,322,001 * 6/1994 Boda ..... 83/614
5,440,961 * 8/1995 Lucas, Jr. et al. ..... 83/614
5,758,559 * 6/1998 Capital, Jr. et al. ..... 83/614
6,041,988 * 3/2000 Shapiro ..... 225/93

* cited by examiner

*Primary Examiner*—W. Donald Bray
(74) *Attorney, Agent, or Firm*—Dougherty & Troxell

(57) ABSTRACT

An aluminum foil safety fixture with a slide plate to gradually separate aluminum foil in a safe and convenient cutting process. It eliminates the need for a steel cutting blade. It is comprised of a slide plate with arched pressing edges, fitted to a push unit that is installed with at least one pair of slide pressing rollers, and movably assembled in a slide rail of a main unit base. The supporting plate extends from the main unit base and the clasp plates can be directly fitted to a wall of an aluminum foil packing box, so that the aluminum foil can be pulled to a certain length, rested on the top of the slide rail, then the push unit is pushed lightly over the aluminum foil. This will depress the aluminum foil and ultimately separate it into two pieces.

1 Claim, 3 Drawing Sheets

ALUMINUM FOIL SAFETY FIXTURE

BACKGROUND OF THE INVENTION

The aluminum foil currently available on the market is generally packed in a paper box, with a serrated cutting blade fitted at an appropriate position on the outside of the packing box. To cut the foil, the user will pull a certain length and apply manual force to the aluminum foil which is aligned at a certain angle on top of the serrated cutting blade. However, in actual application, some users cannot manually control the cutting angle. Often the foil is cut in a way that the user does not want: in an unspecified direction, in an inconsistent size or shape, etc. The resulting piece of foil cannot be used—it is a waste of foil. In addition, the serrated edge that is directly exposed from the side of a packing box (to facilitate cutting process) may cut the hand of a user or a child.

In view of such shortcomings, some manufacturers have introduced some types of aluminum foil cutters, or a multi-purpose cutting device, that is combined with the roll of aluminum foil; it is in essence a slide channel that is attached to a box. The slide channel is fitted with a push handle which includes a built-in cutting knife. The aluminum foil is placed into the slide channel and the cutting edge is pushed across the channel—cutting the aluminum.

This solves the problem of safety and of cutting at an angle other than perpendicular to the lengthwise edge of the piece of foil. However, it requires that the aluminum foil be removed from its packing box, and then placing and fitting the aluminum foil withiin the cutting box. This leads to the packing box being discarded—it is now waste. In addition, and more importantly, the cutting blade is metal and therefore subject to wear and tear during the cutting process. Eventually it too will wear out as its service life is not infinite. In fact due to such wear its service life may be greatly restricted; the pieces of aluminum foil cut later my not be cut smoothly, may become twisted, etc. Again the poorly, or improperly cut aluminum foil becomes is quite inconvenient. At this point the cutting instrument is essentially useless.

SUMMARY OF THE INVENTION

The Aluminum Foil Safety Fixture is a safety device that is fixed onto aluminum foil or its packing box; it covers the aluminum foil, or the packing box's serrated metal blade, so that the aluminum foil can be cut off safely and conveniently without using the cutting blade. It is comprised of a single piece that can be fixed on the side of the box by means of clasp plates. The piece includes a slide rail, and a moveable push unit In the push unit is installed a plastic slide plate that extends toward the slide rail and at least one pair of slide pressing rollers. After a certain length of aluminum foil is pulled out, the push unit is pushed to the slide, then two rollers will press and cut the aluminum foil. The device requires no cutting blade, therefore there will be no wear, etc. that is associated with metal blades and its service life will be greater than that of a comparable metal blade slide cutting device.

BRIEF DESCRIPTION OF ILLUSTRATIONS

DETAILED DESCRIPTION OF DEVICE

Figure 1:
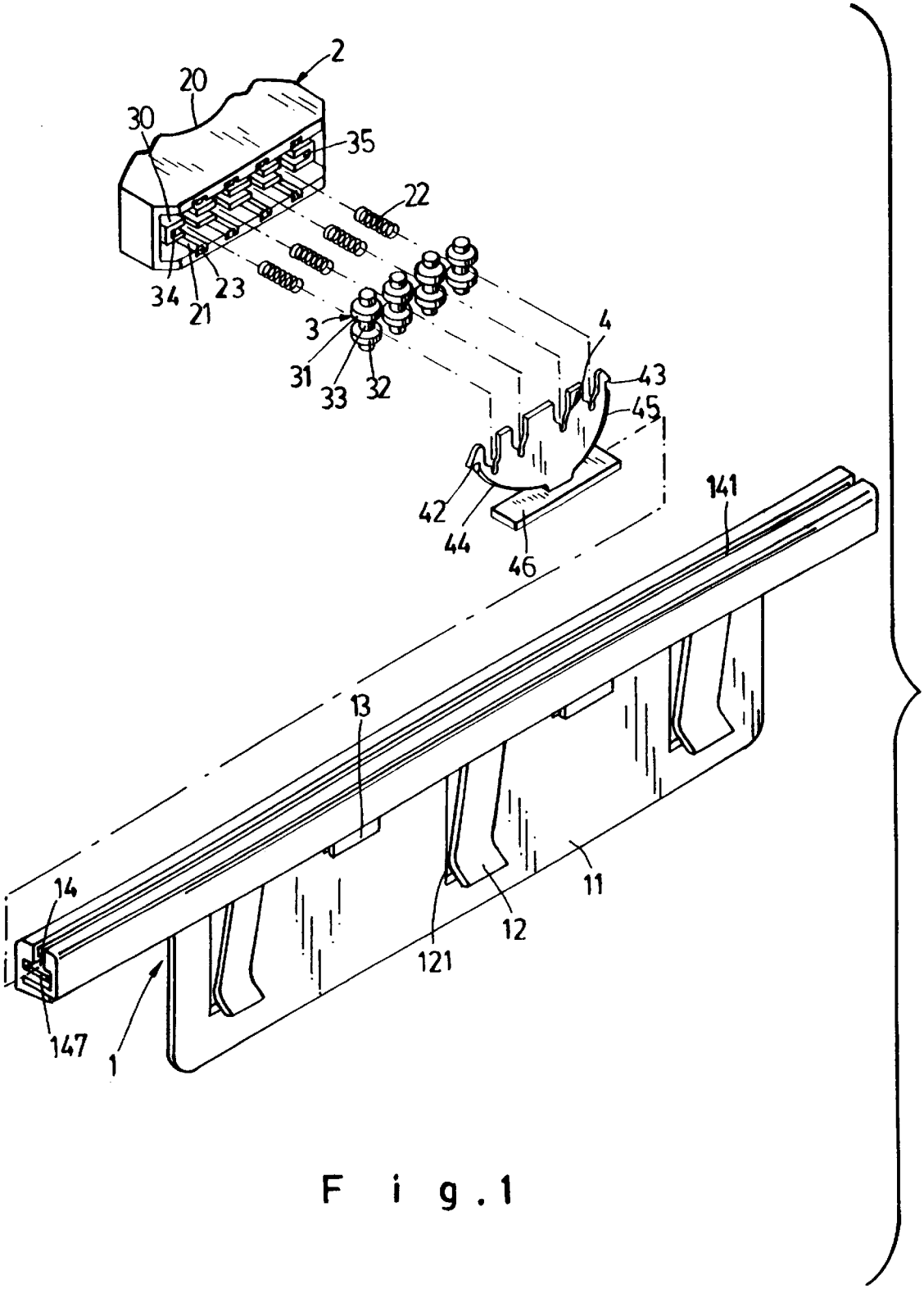
FIG. 1 is am exploded perspective view of the present invention.
Figure 2:
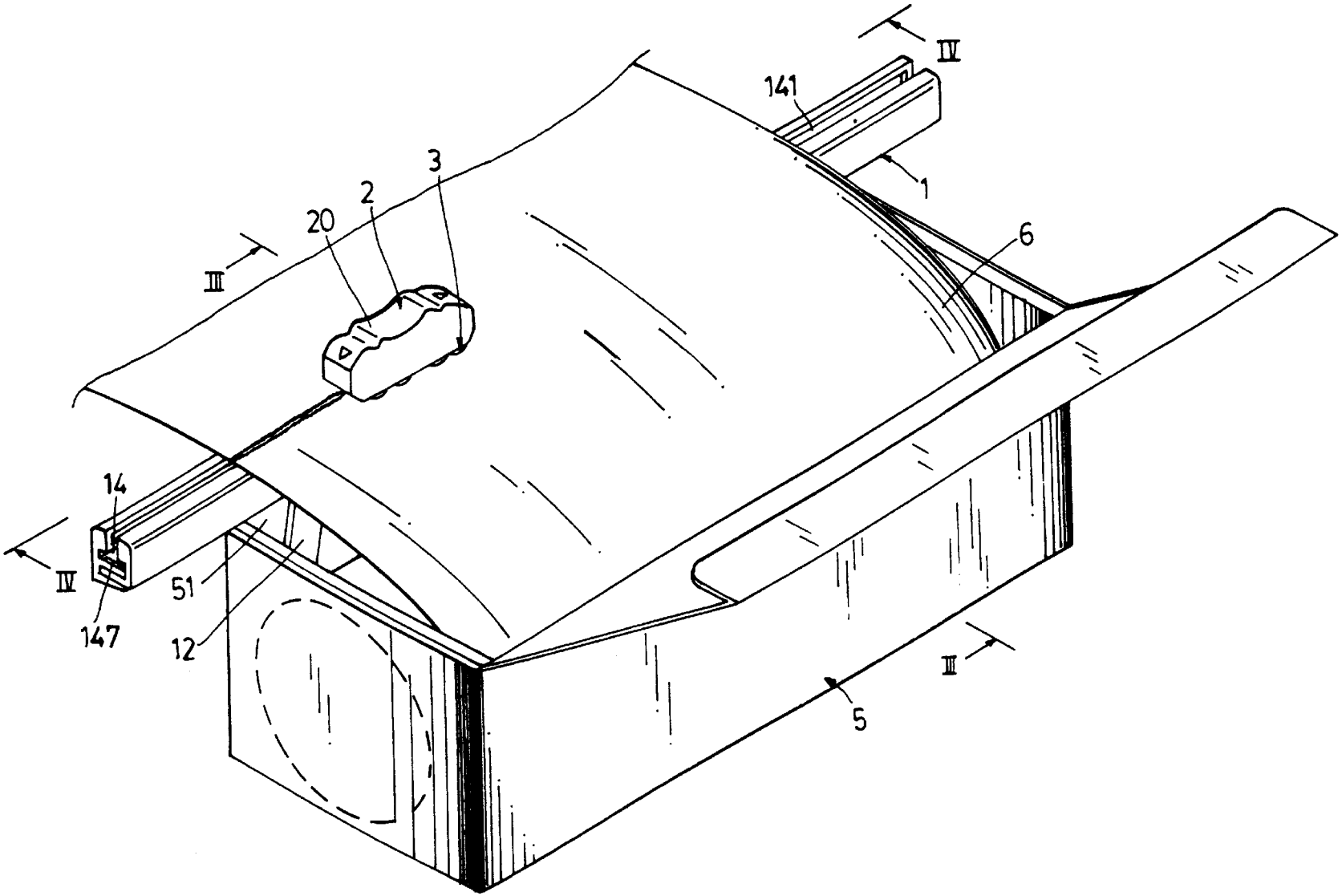
FIG. 2 is a perspective view of the device in use.

Referring FIGS. 1 and 2, the device is comprised of a main unit base (1), a push unit (2), at least one pair of slide press rollers (3) and a slide plate (4). The main unit base (1) is comprised of a supporting plate (11) with an elongated rectangular area, at least one long clasp plate (12) is located on one side of the supporting plate (11), and at least one short clasp plate (13). The clearance formed by the long and short clasp plates (12 & 13) and the supporting plate (11) is designed to accommodate the box wall (51) of the packing box (5) containing a roll of aluminum foil (6).

The long clasp plate (12) with a folded clasp (121) coordinates with the surface of the supporting plate (11) to clasp the box wall (51) of the packing box (5), so that the main unit base (11) can be fitted onto any packing box body (5) containing aluminum foil (as shown in FIG. 2). On top of the supporting plate (11) is the slide rail (14) in the shape of a reversed "T" with a rail opening (141) on its top. In the space inside the slide rail (14) is the protrusion of a pair of rail wall ribs (142) that are opposite each other. Together this configuration forms a space on the bottom, inside the slide rail (14) to facilitate the movement of an auxiliary slide block (46) that corresponds to the slide plate (4). The configuration is designed so that the slide plate (4) will not be pulled upwards or displaced when it is moving, in other words, the space inside said slide rail (14) is designed to accommodate a push unit (2) that is movably fitted therein, and to facilitate the slide plate (4) being pushed inside the slide rail (14).

Figure 3:
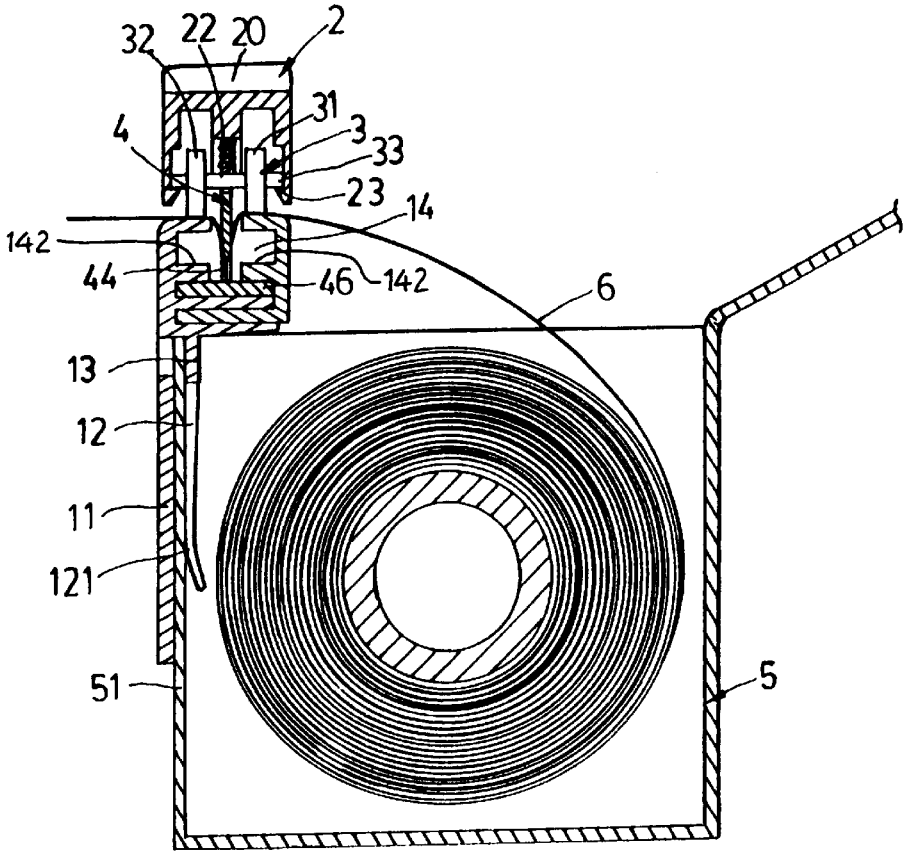
FIG. 3 is a cross-sectional view taken along line III—III in FIG. 2, illustrating the cutting operation.

The push unit (2) assembled in the slide rail (14) is shaped to have a hollow interior with a casing whose topology is that of a wavy depression (20) on its top to facilitate pushing. In the hollow inside is at least one set of slide pressing rollers (3) that will keep the aluminum foil (6) in a tense form during the process. One set of slide pressing rollers (3) includes two rollers (31 & 32) that are opposite to each other and mounted on a rolling shaft (33), fitted with a spring (22) inside a shaft groove (21). Inside the two side walls of the push unit (2), is a reverse-direction protruded shoulder (23) that is formed at the end of the shaft groove (21) to correspond to the end of the rolling shaft (33) (as shown in FIG. 3). When the two rollers (31 & 32) are partially exposed from the end of the push unit (2), they will not be disengaged due to the force of the spring (22). In other words, while the rollers (31 & 32) slide in the push unit (2) under the pressure of said spring (22) to enable the slide plate (4) to cut the aluminum foil (6), the rollers (31 & 32) will apply flexible pressure on the aluminum foil (6) to make it tense and steady. The tensing and stretching actions of the slide pressing roller (3) will automatically coordinate with the advance of the pressing edge (44 or 45), of the slide plate (4) during the pressing, extending and cutting processes. This will assure that the aluminum foil (6) is maintained in a tense and smooth condition to facilitate the cutting process. Slide plate (4) is a flattened plate made of plastic, on each of two sides near its top is a dent (42 & 43) which corresponds to two protruded snaps (34 & 35) on two sides of the assembled unit (30) on the inside of the push unit (2) (shown in FIGS. 1 and 4): on and on the ends of two sides of the slide plate (4) are arched pressing edges (44 & 45), the edges (44 & 45) force the aluminum foil to spread towards the slide rail (14), and when it goes beyond a critical point, it is separated. On the ends of two pressing edges (44 & 45) is an auxiliary slide block (46) that can be assembled in the slide rail (14) to mitigate the stress and guide the slide plate (4)—so that the slide plate will not separate from the top as it moves in the slide rail (14). The ends of the auxiliary slide block (46) will be joined inside the slide rail (14) to form a protruded stop block (147), so that it will not come out of the slide rail (14) during the sliding process.

Figure 4:
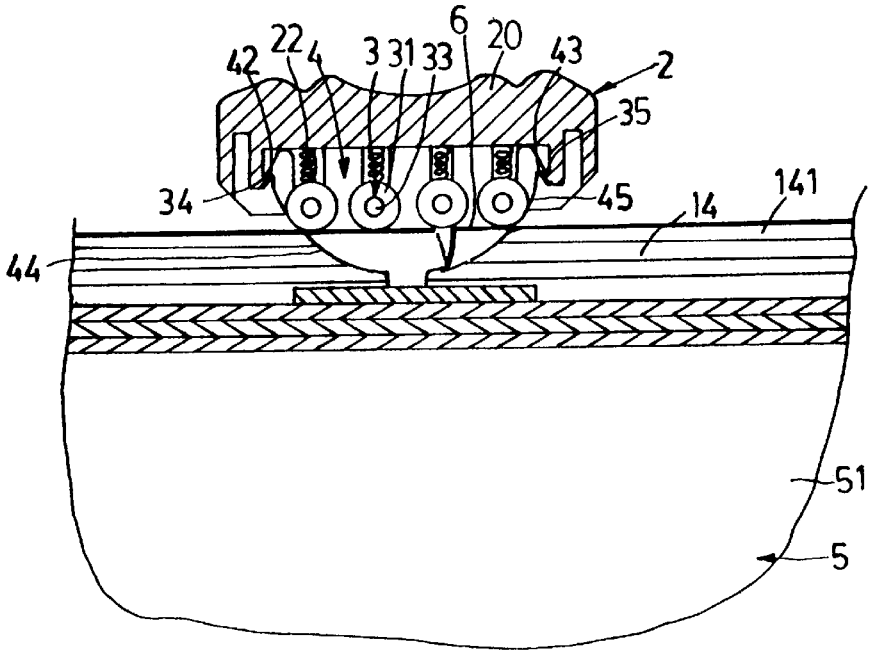
FIG. 4 is a Cross-section view taken along line IV—IV in FIG. 2, illustrating the cutting operation.

After all components of the device are assembled, its operation is shown in FIGS. 2 through 4. It is operated in the following steps:

I) fit the cutting device with its long and short clasp plates (12 & 13) and the supporting plate (11) onto the box wall (51) of a packing box (5) containing an opened roll of aluminum foil (6) (as shown in FIGS. 2 and 3);

II) pull out an appropriate length of the aluminum foil (6) from the packing box body (5) and lightly rest it on the top of the rail hole (141) of the slide rail (14);

III) lightly push the push unit (2) from one end of the slide rail to the other end of the slide rail (14). As the push unit (2) moves the two rollers (31 & 32) of the at least one set of slide pressing rollers (3) will ride on top of the slide rail (14) to depress and tense the aluminum foil (6), then the pressing edge (44 or 45) of the slide plate (4) will move along with the push unit (2) to gradually depress the aluminum foil (6), making it gradually spread toward the slide rail (14). Once the stress on the aluminum foil is great enough it will separate into two pieces (as shown in FIG. 4).

Due to the installation of the pressing edges (44 & 45) on two sides, the slide plate (4) may directly be pushed in the opposite direction of the push unit (2) after the pressing edge (44) has accomplished its cutting operation. The aluminum foil is separated without the use of a steel cutting blade or edge, so there is no risk of blunt edge or rust corrosion, and there will be no danger of causing cutting injury to the user.

When a length of aluminum foil (6) is to be cut all the user has to do is to rest the aluminum foil (6) on top of the rail hole (141) of the slide rail (14), then the user's hand can lightly press the push unit (2) and push it to the other end of the slide rail (14). This motion will cause the arched press edge to depress the aluminum foil (6) and force it to extend gradually, when it reaches the extension limit the aluminum foil is cut off. Its operation is quite convenient, furthermore, all the above components can be made of extruded plastics, including the slide plate. It can be mass produced for a very low cost. It is cannot cause injury. it does not rust—being there are no metal parts. In short, it is very suitable for daily consumers.

What is claimed is:

1. An aluminum foil safety fixture for separating a piece of aluminum foil from a roll of aluminum foil in a packing box, the safety fixture comprising:

a) a main unit base having: an elongated slide rail with an upwardly opening, inverted "T" shaped rail opening extending therealong, the elongated slide rail having a pair of flanges facing toward each other and extending along a length of the elongated slide rail on opposite sides of the rail opening, and a pair of rail wall ribs facing toward each other and spaced from the pair of flanges and from each other so as to form a space therebetween; a supporting plate extending downwardly from the elongated slide rail; and at least one clasp plate extending downwardly from the elongated slide rail and spaced from the supporting plate such that a wall of the packing box may be accommodated therebetween so as to removably attach the main unit base to the packing box;

b) a slide plate made of plastic material and extending through the inverted "T" shaped opening exteriorly of the elongated slide rail and through the space between the pair of rail wall ribs, the slide plate having oppositely facing convexly arcuate pressing edges, the pressing edges extending into the inverted "T" shaped opening, the slide plate further including a slide block engaging sides of the rail wall ribs facing away from the pair of flanges; and, c) a push unit attached to the slide plate and located outside of the elongated slide rail, the push unit comprising an upper pushing surface and a hollow interior, a plurality of pressing roller assemblies mounted to the push unit, each roller assembly having a rolling shaft and two rollers located on opposite sides of the slide plate, such that two rollers roll on surfaces of the pair of flanges facing away from the rail wall ribs, a spring acting between the push unit and each rolling shaft urging the pressing roller assemblies away from the hollow interior of the push unit, and protruding shoulders engaging the rolling shaft to prevent disengagement of the roller assemblies from the push unit.

* * * * *